US009376910B2

(12) United States Patent
Proett et al.

(10) Patent No.: US 9,376,910 B2
(45) Date of Patent: Jun. 28, 2016

(54) DOWNHOLE FORMATION TESTING AND SAMPLING APPARATUS HAVING A DEPLOYMENT PACKER

(71) Applicant: Halliburton Energy Services, Inc., Houston, TX (US)

(72) Inventors: Mark A. Proett, Missouri City, TX (US); Clovis S. Bonavides, Houston, TX (US)

( * ) Notice: Subject to any disclaimer, the term of this patent is extended or adjusted under 35 U.S.C. 154(b) by 420 days.

(21) Appl. No.: 13/842,507

(22) Filed: Mar. 15, 2013

(65) Prior Publication Data

US 2013/0213645 A1 Aug. 22, 2013

Related U.S. Application Data

(63) Continuation-in-part of application No. 13/562,870, filed on Jul. 31, 2012, now Pat. No. 8,522,870, which is a continuation of application No. 12/688,991, filed on Jan. 18, 2010, now Pat. No. 8,235,106, which is a continuation of application No. 11/590,027, filed on Oct. 30, 2006, now Pat. No. 7,650,937, which is a continuation of application No. 10/384,470, filed on Mar. 7, 2003, now Pat. No. 7,128,144.

(51) Int. Cl.
*E21B 49/10* (2006.01)
*E21B 49/08* (2006.01)

(52) U.S. Cl.
CPC ..... *E21B 49/088* (2013.01); *E21B 49/10* (2013.01)

(58) Field of Classification Search
CPC ..... E21B 49/10
See application file for complete search history.

(56) References Cited

U.S. PATENT DOCUMENTS

| | | | | | |
|---|---|---|---|---|---|
| 2,441,894 | A | * | 5/1948 | Mennecier | 166/63 |
| 2,613,747 | A | * | 10/1952 | West | 166/100 |
| 2,675,080 | A | * | 4/1954 | Williams | 166/100 |
| 2,905,247 | A | * | 9/1959 | Vestermark | 166/100 |
| 2,959,226 | A | * | 11/1960 | Blood | 166/100 |
| 2,965,176 | A | * | 12/1960 | Brieger et al. | 166/63 |
| 3,011,554 | A | * | 12/1961 | Desbrandes et al. | 166/100 |
| 3,181,608 | A | * | 5/1965 | Palmer | 166/250.02 |
| 3,270,814 | A | * | 9/1966 | Richardson et al. | 166/291 |
| 3,396,796 | A | * | 8/1968 | Voetter | 166/100 |
| 3,452,592 | A | * | 7/1969 | Voetter | 73/152.26 |
| 4,470,456 | A | * | 9/1984 | Moutray, III | 166/100 |
| 5,549,159 | A | * | 8/1996 | Shwe et al. | 166/250.02 |

* cited by examiner

*Primary Examiner* — Robert E Fuller

(57) ABSTRACT

A downhole formation testing and sampling apparatus. The apparatus includes an expandable packer having a radially contracted running configuration and a radially expanded deployed configuration. At least one elongated sealing pad is operably associated with the expandable packer such that operating the expandable packer from the running configuration to the deployed configuration establishes a hydraulic connection between the at least one elongated sealing pad and the formation. The at least one elongated sealing pad has at least one opening establishing fluid communication between the formation and the interior of the apparatus. In addition, the at least one elongated sealing pad has an outer surface operable to seal a region along a surface of the formation to establish the hydraulic connection therewith. The at least one elongated sealing pad further has at least one recess operable to establish fluid flow from the formation to the at least one opening.

18 Claims, 5 Drawing Sheets

DOWNHOLE FORMATION TESTING AND SAMPLING APPARATUS HAVING A DEPLOYMENT PACKER

CROSS-REFERENCE TO RELATED APPLICATIONS

This patent application is a continuation-in-part of U.S. patent application Ser. No. 13/562,870 filed Jul. 31, 2012 which is a continuation of U.S. patent application Ser. No. 12/688,991 filed Jan. 18, 2010, now U.S. Pat. No. 8,235,106, issued Aug. 7, 2012, which is a continuation of U.S. patent application Ser. No. 11/590,027 filed Oct. 30, 2006, now U.S. Pat. No. 7,650,937, issued Jan. 26, 2010, which is a continuation of U.S. patent application Ser. No. 10/384,470 filed Mar. 7, 2003, now U.S. Pat. No. 7,128,144, issued Oct. 31, 2006. The entire disclosure of these prior applications is incorporated herein by this reference.

TECHNICAL FIELD OF THE PRESENT DISCLOSURE

This disclosure relates, in general, to equipment utilized in conjunction with operations performed in relation to hydrocarbon bearing subterranean wells and, in particular, to a downhole formation testing and sampling apparatus and a method for testing and sampling formation fluid.

BACKGROUND

Without limiting the scope of the present disclosure, its background will be described with reference to evaluation of hydrocarbon bearing subterranean formations, as an example.

It is well known in the subterranean well drilling and completion art to perform tests on formations intersected by a wellbore. Such tests are typically performed in order to determine geological or other physical properties of the formation and fluids contained therein. For example, parameters such as permeability, pore pressure, porosity, fluid resistivity, directional uniformity, temperature, pressure, bubble point and fluid composition may be determined. These and other characteristics of the formation and fluid contained therein may be determined by performing tests on the formation before the well is completed.

One type of tool used for testing formations includes an elongated tubular body divided into several modules serving predetermined functions. For example, the testing tool may have a hydraulic power module that converts electrical into hydraulic power, a telemetry module that provides electrical and data communication between the modules and an uphole control unit, one or more probe modules that collect samples of the formation fluids, a flow control module that regulates the flow of formation and other fluids in and out of the tool and a sample collection module that may contain one or more chambers for storage of the collected fluid samples.

The probe modules may have one or more probe-type devices that create a hydraulic connection with the formation in order to measure pressure and take formation samples. Typically, these devices use a toroidal rubber cup-seal, which is pressed against the side of the wellbore while a probe is extended from the tester in order to extract wellbore fluid and affect a drawdown. The rubber seal of the probe is typically about 3-5 inches in diameter, while the probe itself is only about half an inch to an inch in diameter. It has been found, however, that due to the small area contacted by such probes, a hydrocarbon deposit or other valuable information may be missed.

Attempts have been made to overcome the above sampling limitations using, for example, straddle packers in association with a downhole formation testing tool. The straddle packers are inflatable devices typically mounted on the outer periphery of the tool and can be placed as far as several meters apart from each other. When expanded, the packers isolate a section of the wellbore and samples of the formation fluid from the isolated area can be drawn through one or more inlets located between the packers. Although the use of straddle packers may significantly improve the flow rate over the conventional probe-type devices described above, the straddle packer type testing tools also have several important limitations. For example, the volume of fluid between the straddle packers results in long clean up time and, even after clean up, the samples are not obtained directly from the formation.

Therefore, a need has arisen for an improved downhole formation testing and sampling apparatus that is operable to provide an accurate estimate of a reservoir's producibility. A need has also arisen for such an improved downhole formation testing and sampling apparatus that is operable to provide a large exposure volume without requiring a long clean up time. Further, a need has arisen for such an improved downhole formation testing and sampling apparatus that is operable to obtain fluid samples directly from the formation.

BRIEF DESCRIPTION OF THE DRAWINGS

For a more complete understanding of the present disclosure, reference is now made to the detailed description of the various embodiments along with the accompanying figures in which corresponding numerals in the different figures refer to corresponding parts and in which.

DETAILED DESCRIPTION

Figure 1:
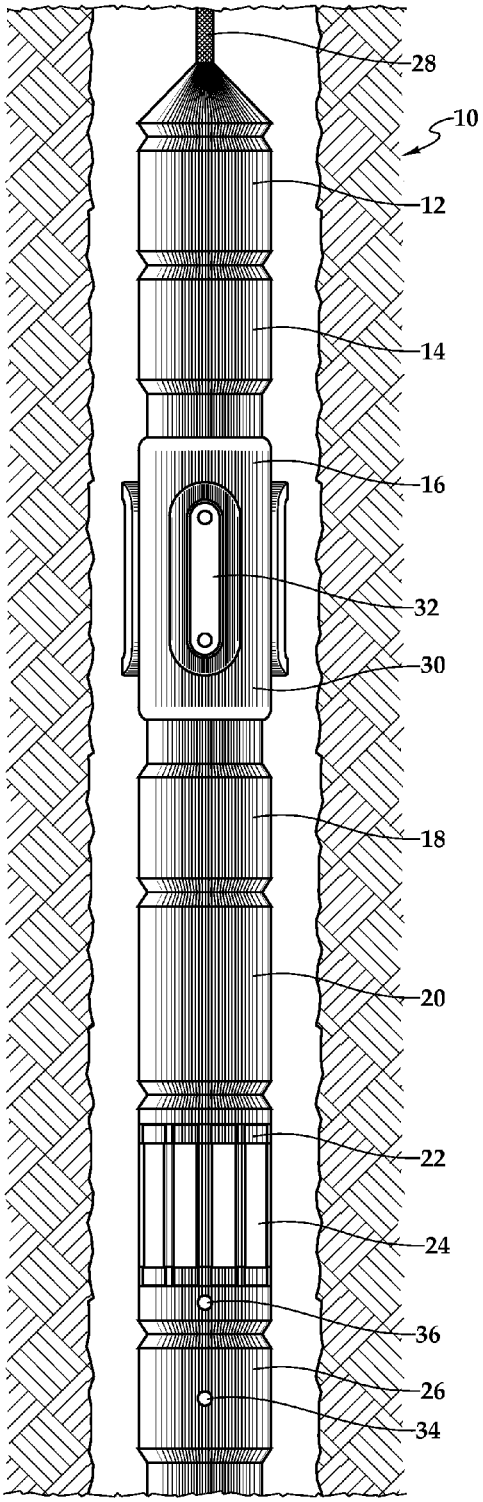
FIG. 1 is a schematic illustration of a well system including a downhole formation testing and sampling apparatus in its running configuration.

While various system, method and other embodiments are discussed in detail below, it should be appreciated that the present disclosure provides many applicable inventive concepts, which can be embodied in a wide variety of specific contexts. The specific embodiments discussed herein are merely illustrative, and do not delimit the scope of the present disclosure.

The present disclosure is directed to an improved downhole formation testing and sampling apparatus that is operable to provide an accurate estimate of a reservoir's producibility. The improved downhole formation testing and sampling apparatus of the present disclosure is operable to provide a large exposure volume without requiring a long clean up time. In addition, the improved downhole formation testing and sampling apparatus of the present disclosure is operable to obtain fluid samples directly from the formation.

In one aspect, the present disclosure is directed to a downhole formation testing and sampling apparatus. The apparatus includes an expandable packer having a radially contracted running configuration and a radially expanded deployed configuration. At least one elongated sealing pad is operably associated with the expandable packer and has an outer surface operable to seal a region along a surface of the formation to establish a hydraulic connection therewith when the expandable packer is operated from the running configuration to the deployed configuration. The at least one elongated sealing pad has at least one opening establishing fluid communication between the formation and the interior of the apparatus. In addition, the at least one elongated sealing pad has at least one recess operable to establish fluid flow from the formation to the at least one opening.

In one embodiment, the apparatus may include a fluid collection chamber for storing samples of retrieved fluids. In another embodiment, the apparatus may include one or more sensors for determining one or more properties of the collected fluid. In further embodiments, the apparatus may include a pumping system operably associated with the expandable packer and operable to selectively inflate the expandable packer. In certain embodiments, the at least one elongated sealing pad may be formed from an elastomeric material. In such embodiments, the elastomeric material may be reinforced with a steel aperture near the at least one opening of the at least one elongated sealing pad. In some embodiments, the at least one elongated sealing pad is replaceable. In certain embodiments, the at least one elongated sealing pad may include a filter medium. In other embodiments, the region of the formation surface sealed by the at least one elongated sealing pad may be elongated and may be oriented along a longitudinal axis of a borehole. In one embodiment, the at least one elongated sealing pad may have at least elongated one recess operable to establish fluid flow from the formation to the at least one opening.

In another aspect, the present disclosure is directed to a downhole formation testing and sampling apparatus. The apparatus includes an expandable packer having a radially contracted running configuration and a radially expanded deployed configuration. A plurality of elongated sealing pads is operably associated with the expandable packer. Each of elongated sealing pads has an outer surface operable to seal a region along a surface of the formation to establish a hydraulic connection therewith when the expandable packer is operated from the running configuration to the deployed configuration. Each of the elongated sealing pads has at least one opening establishing fluid communication between the formation and the interior of the apparatus. In addition, each of the elongated sealing pads has at least one recess operable to establish fluid flow from the formation to the at least one opening.

In one embodiment, the elongated sealing pads may be circumferentially distributed about the expandable packer. In certain embodiments, the elongated sealing pads may be uniformly circumferentially distributed about the expandable packer. In another embodiment, the elongated sealing pads may be longitudinally distributed about the expandable packer. In other embodiments, the elongated sealing pads may be circumferentially and longitudinally distributed about the expandable packer.

In a further aspect, the present disclosure is directed to a method of testing and sampling formation fluid. The method includes running a formation testing and sampling apparatus into a borehole, the apparatus having an expandable packer and at least one elongated sealing pad operably associated with the expandable packer, the at least one elongated sealing pad having at least one opening in fluid communication with the interior of the apparatus, the at least one elongated sealing pad having an outer surface operable to seal a region along a surface of the formation to establish a hydraulic connection therewith and the at least one elongated sealing pad having at least one elongated recess operable to establish fluid flow from the formation to the at least one opening. The method also includes pumping a fluid into the expandable packer to inflate the expandable packer from a radially contracted running configuration to a radially expanded deployed configuration; establishing the hydraulic connection between the at least one elongated sealing pad and the formation and drawing fluid from the region of the formation into the apparatus.

The method may also include collecting the fluid in a fluid collection chamber of the apparatus; sensing at least one characteristic of the fluid drawn into the apparatus; regulating the drawdown of fluids into the apparatus using a control device of the apparatus and/or establishing a hydraulic connection between a plurality of elongated sealing pads and the formation.

Referring initially to FIG. 1, a schematically illustrated well system includes a downhole formation testing and sampling apparatus 10 being lowered into a wellbore. Formation testing and sampling apparatus or tool 10 includes a plurality of modules or sections capable of performing various functions. In the illustrated embodiment, tool 10 include a power telemetry module 12 that provides electrical and data communication between the modules of tool 10 and a remote control unit (not pictured) that may be located uphole or at the surface, a pumping module 14 that converts electrical power into hydraulic power, a probe module 16 that takes samples of the formation fluids, a fluid test module 18 that performs various tests on a fluid sample, a flow control module 20 that regulates the flow of fluids in and out of tool 10, a multi-chamber sample collection module 22 that includes a plurality of chambers 24 for storage of the collected fluid samples and possibly other sections designated collectively as module 26. Even though a particular arrangement of the various modules has been described and depicted in FIG. 1, those skilled in the art will understand that other arrangements of modules including both a greater number and a lesser number of modules is possible and is considered to be within the scope of the present disclosure.

More specifically, power telemetry section 12 conditions power for the remaining tool sections. Each section preferably has its own process-control system and can function independently. While section 12 provides a common intra-tool power bus, the entire tool string shares a common communication bus that is compatible with other logging tools. In the illustrated embodiment, tool 10 is conveyed in the borehole by wireline 28, which contains conductors for carrying power to the various components of tool 10 and conductors or cables such as coaxial or fiber optic cables for providing two-way data communication between tool 10 and the remote control unit. The control unit preferably comprises a computer and associated memory for storing programs and data. The control unit generally controls the operation of tool 10 and processes data received from it during operations. The control unit may have a variety of associated peripherals, such as a recorder for recording data, a display for displaying desired information, printers and the like. The use of the control unit, display and recorder are known in the art of well logging and are, thus, not discussed further. In a specific embodiment, telemetry module 12 may provide both electrical and data communication between the modules and the control unit. In particular, telemetry module 12 provides a high-speed data bus from the control unit to the modules to download sensor readings and upload control instructions initiating or ending various test cycles and adjusting different parameters, such as the rates at which various pumps are operating. Even though tool 10 has been depicted as being wireline conveyed, it should be understood by those skilled in the art that tool 10 could alternatively be conveyed by other means including, but not limited to, coiled tubing or jointed tubing such as drill pipe. It should also be noted that tool 10 could be part of a logging while drilling (LWD) tool string wherein power for the tool systems may be generated by a turbine driven by circulating mud and data may be transmitted using a mud pulse module.

Figure 2:
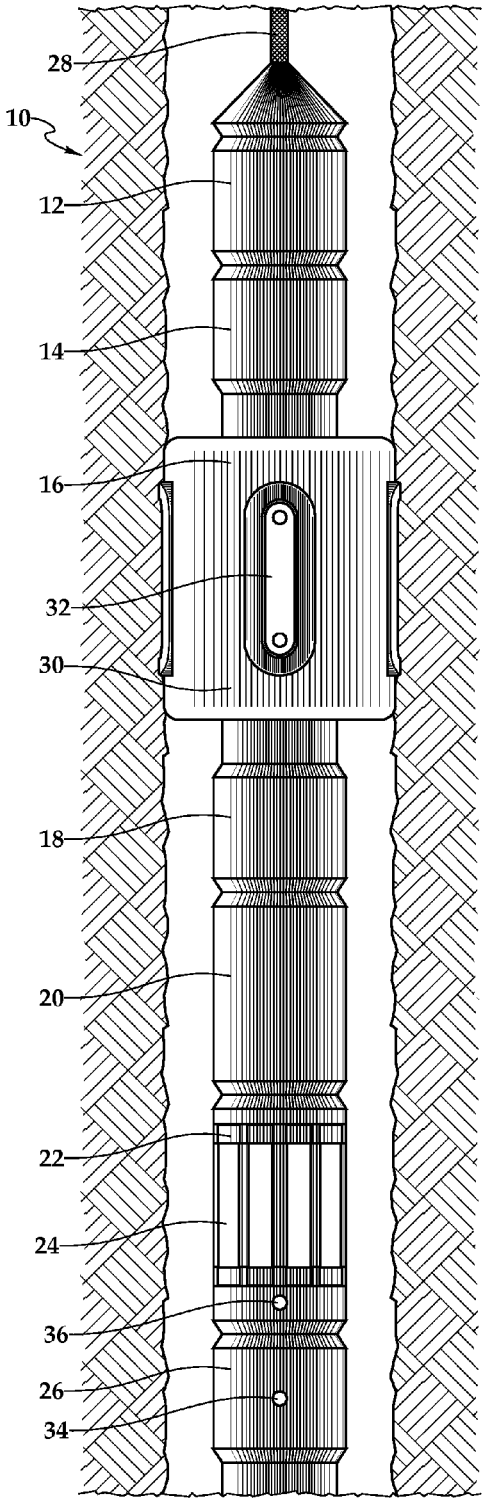
FIG. 2 is a schematic illustration of a well system including a downhole formation testing and sampling apparatus in its deployed configuration.

Pumping module 14 is operably associated with an expandable packer 30 of probe module 16. Pumping module 14 includes an electric pump that is operated to pump a fluid, for example well fluid, into the interior of expandable packer 30 via a supply conduit (not visible in FIG. 1) to inflate expandable packer 30 from the radially contracted running configuration depicted in FIG. 1 to the radially expanded deployed configuration depicted in FIG. 2, which establishes a hydraulic connection between probes 32 and the formation. The pump operation is generally monitored by the control unit. More specifically, expandable packer 30 may have an inner bladder that is inflated by pumping module 14. Expandable packer 30 may also have a mechanical layer disposed exteriorly of the inner bladder. The mechanical layer preferably includes a mesh or other structural material that provides strength to expandable packer 30 and is operable for repeated expansion and contraction. The mechanical layer may also include various fluid conduits that route the fluid samples from probes 32 to the interior of tool 10. Expandable packer 30 preferably includes one or more outer sealing layers formed from a sealing material, such as an elastomer, that are operable for sealing engagement with the surface of the wellbore. As such, when fluid is pumped by pumping module 14 into the interior of the inner bladder, the inner sealing bladder expands radially causing radial expansion of the mechanical layer and radial expansion of the outer sealing layers. This radial expansion establishes the hydraulic connection between probes 32 and the formation. In addition, this radial expansion preferably creates a sealing engagement between the outer sealing layers of expandable packer 30 and the surface of the wellbore.

Fluid testing section 18 of tool 10 contains one or more fluid testing devices (not visible in FIG. 1), which analyze the fluid samples obtained during sampling operations. For example, one or more fluid sensors may be utilized to analyze the fluid such as quartz gauges that enable measurement of such parameters as the drawdown pressure of fluid being withdrawn and fluid temperature. In addition, if at least two fluid testing devices are run in tandem, the pressure difference between them can be used to determine fluid viscosity during pumping or fluid density when flow is stopped. Also, when flow is stopped, a pressure buildup analysis can be preformed.

Flow control module 20 of tool 10 includes a pump such as a double acting piston pump (not visible in FIG. 1), which controls the formation fluid flow into tool 10 from probes 32. The pump's operation is generally monitored by the control unit. Fluid entering probes 32 flows through one or more flow lines (not visible in FIG. 1) and may be discharged into the wellbore via outlet 34. Fluid control devices, such as control valves and/or a manifold (not visible in FIG. 1), may be connected to the flow lines for controlling the fluid flow from the flow lines into the borehole or into storage chambers 24. Flow control module 18 may further include strain-gauge pressure transducers that measure inlet and outlet pump pressures.

Sample collection module 22 of tool 10 may contain various size chambers 24 for storage of the collected fluid samples. Chamber section 22 preferably contains at least one collection chamber 24, preferably having a piston that divides chamber 24 into a top chamber and a bottom chamber. A conduit may be coupled to the bottom chamber to provide fluid communication between the bottom chamber and the outside environment such as the wellbore via one or more fluid ports 36. A fluid flow control device, such as an electrically controlled valve, can be placed in the conduit to selectively open it to allow fluid communication between the bottom chamber and the wellbore. Similarly, chamber section 24 may also contain a fluid flow control device, such as an electrically operated control valve, which is selectively opened and closed to direct the formation fluid from the flow lines into the upper chamber. Preferably, one or more sensors are used to determine when the formation fluid is clean then the control valve is opened to allow a sample to be taken. As a sample is taken in the upper side of chamber 24, the piston may be driven down to the bottom of the chamber. Thereafter, the sample may be over pressured to maintain sample integrity.

Probe module 16 includes a plurality of probes 32, three of four being visible in FIG. 1, that are uniformly circumferentially distributed around expandable packer 30. Probes 32 facilitate testing, sampling and retrieval of fluids from the formation. Each probe 32 includes a sealing pad that makes contact with the formation. In certain embodiments, probes 32 are provided with at least one elongated sealing pad providing sealing contact with a surface of the borehole. Through one or more slits, fluid flow channels or recesses in the sealing pad, fluids from the sealed-off part of the formation surface may be collected within tester tool 10 through one or more fluid flow paths within probe module 16 and tool 10. The recess or recess in each pad may be elongated, preferably along the axis of the elongated pad and generally in the direction of the borehole axis.

Figure 3:
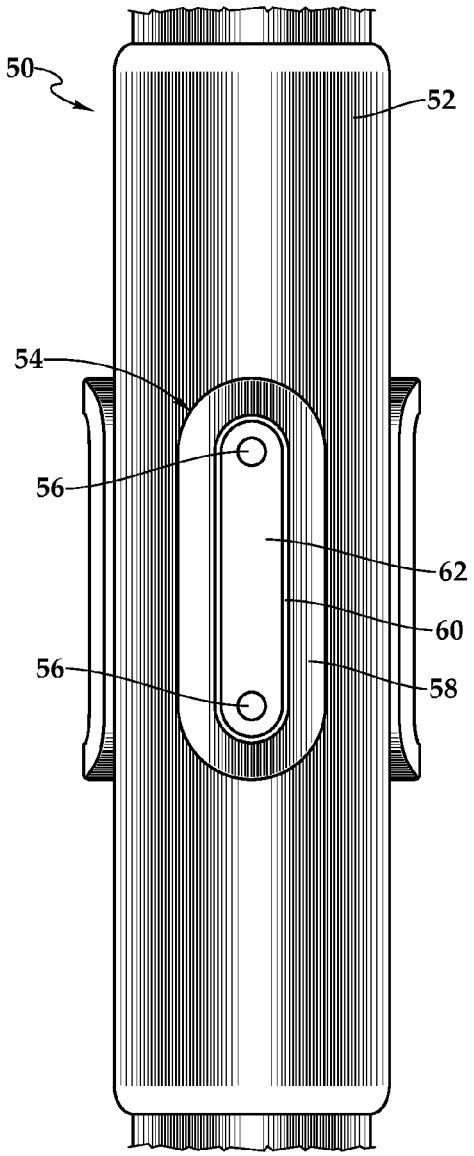
FIG. 3 is a schematic illustration of an embodiment of a probe module for use in a downhole formation testing and sampling apparatus.

Referring now to FIG. 3, therein is depicted one embodiment of a probe module that is generally designated 50. In the illustrated embodiment, probe module 50 includes an expandable packer 52 that may have an inner bladder, a mechanical layer disposed exteriorly of the inner bladder and one or more outer sealing layers, as described above. When fluid is pumped into the interior of the inner bladder, the inner sealing bladder expands radially causing radial expansion of the mechanical layer and radial expansion of the outer sealing layers. This radial expansion establishes a hydraulic connection between probes 54 and the formation. In addition, this radial expansion preferably creates a sealing engagement between the outer sealing layers of expandable packer 52 and the surface of the wellbore. Probe module 50 also includes a plurality of probes 54, three of four being visible in FIG. 3, that are uniformly circumferentially distributed around expandable packer 52. Probes 54 facilitate testing, sampling and retrieval of fluids from the formation. Probes 54 may have high-resolution temperature compensated strain gauge pressure transducers (not visible in FIG. 3) that can be isolated with shut-in valves (not visible in FIG. 3) to monitor independent pressures associate with probes 54. In addition, other sensors such as resistivity or optical sensors (not visible in FIG. 3) located near probes 54 may be used to monitor fluid properties immediately after fluid enters a probe 54.

Probe module 50 generally allows retrieval and sampling of formation fluids in sections or regions of a formation along the longitudinal axis of the borehole. In the illustrated embodiment, each probe 54 includes two inlets 56 for independently obtaining fluid samples. Based upon the testing procedure being performed, the flow into the two inlets 56 of each probe 54 as well as the flow into each probe 54 may be maintained as independent or commingled as desired by operation of control valves and manifolding within tool 10. Likewise, the flow into or shut off of each inlet 56 of each probe 54 as well as the flow into or shut off of each probe 54 may be controlled by operation of control valves and manifolding within tool 10. The fluid control operation is generally monitored by the control unit. In the illustrated embodiment, each probe 54 includes an elongated sealing pad 58 for sealing off a portion or region on the sidewall of a borehole. Sealing pads 58 may be removably attached to expandable packer 52 by suitable connection for easy replacement or sealing pads 58 may be molded to or integral with the material of expandable packer 52. Sealing pads 58 are preferably made of elastomeric material, such as rubber, compatible with the well fluids and the physical and chemical conditions expected to be encountered in an underground formation. Each sealing pad 58 includes a slot or recess 60 cut into the face of the pad having a rigid aperture plate with a raised lip referred to herein and described below as a steel aperture 62. The aforementioned two inlets 56 are cut through steel aperture 62. In some embodiments, a screen element, a gravel pack, sand pack or other filter medium may be positioned within steel aperture 62 to filter migrating solid particles such as sand and drilling debris from entering the tool. In the illustrated embodiment, sealing pads 58 provide a large exposure area to the formation for testing and sampling of formation fluids across laminations, fractures and vugs.

In operation, probe module 50 would be positioned in a tool string such as tool 10 described above. Tool 10 is conveyed into the borehole by means of wireline 28 or other suitable conveying means to a desired location or depth in the well. The pumping module 14 of tool 10 is then operated to radial expand expandable packer 52, thereby creating a hydraulic seal between sealing pads 58 and the wellbore wall at the zone of interest. Once sealing pads 58 of probes 54 are set, a pretest may be performed. The pretest involves, a pretest pump disposed with tool 10 used to draw a small sample of the formation fluid from the region sealed off by sealing pads 58 into the one or more flow lines of tool 10, while the fluid flow is monitored using pressure gauges. As the fluid sample is drawn into the flow lines, the pressure decreases due to the resistance of the formation to fluid flow. When the pretest stops, the pressure in the flow lines increases until it equalizes with the pressure in the formation. This is due to the formation gradually releasing the fluids into the probes 54. The pressure drawdown and buildup can be analyzed to determine formation pressure and permeability.

A formation's permeability and isotropy can be determined, for example, as described in U.S. Pat. No. 5,672,819, the content of which is incorporated herein by reference. For a successful performance of these tests, isolation between two inlets 56 of a probe 54 or between at least two probes 54 is preferred. The tests may be performed as follows. Each probe 54 is radially outwardly shifted upon inflation of expandable packer 52 to form a hydraulically sealed connection between its sealing pad 58 and the formation. Then, one inlet 56, for example, is isolated from the internal flow line by a control valve while the other inlet 56 is open to flow. Flow control module 20 then begins pumping formation fluid through probe 54. If flow control module 20 uses a piston pump that moves up and down, it generates a sinusoidal pressure wave in the contact zone between sealing pad 58 and the formation. The isolated inlet 56, located a short distance from the flowing inlet 56, senses properties of the wave to produce a time domain pressure plot, which is used to calculate the amplitude or phase of the wave. The tool then compares properties of the sensed wave with properties of the propagated wave to obtain values that can be used in the calculation of formation properties. For example, phase shift between the propagated and sensed wave or amplitude decay can be determined. These measurements can be related back to formation permeability and isotropy via known mathematical models.

It should be understood by those skilled in the art that probe module 50 enables improved permeability and isotropy estimation of reservoirs having heterogeneous matrices. Due to the large area of sealing pads 58, a correspondingly large area of the underground formation can be tested simultaneously, thereby providing an improved estimate of formation properties. For example, in laminated or turbidite reservoirs, in which a significant volume of oil or a highly permeable stratum is often trapped between two adjacent formation layers having very low permeabilities, elongated sealing pads 58 will likely cover several such layers. The pressure created by the pump, instead of concentrating at a single point in the vicinity of the fluid inlets, is distributed along recess 60, thereby enabling formation fluid testing and sampling in a large area of the formation hydraulically sealed by elongated sealing pads 58. Thus, even if there is a thin permeable stratum trapped between several low-permeability layers, such stratum will be detected and its fluids will be sampled. Similarly, in naturally fractured and vugular formations, formation fluid testing and sampling can be successfully accomplished over matrix heterogeneities. Such improved estimates of formation properties will result in more accurate prediction of a hydrocarbon reservoir's producibility.

To collect the fluid samples in the condition in which such fluid is present in the formation, the area near sealing pads 58 is flushed or pumped. The pumping rate of a double acting piston pump in flow control module 20 may be regulated such that the pressure in the flow line or lines near sealing pads 58 is maintained above a particular pressure of the fluid sample. Thus, while fluid samples are being obtained, the fluid testing devices of fluid testing module 18 can measure fluid properties. These devices preferably provide information about the contents of the fluid and the presence of any gas bubbles in the fluid to the control unit. By monitoring the gas bubbles in the fluid, the flow in the flow lines can be constantly adjusted to maintain a single-phase fluid in the flow lines. These fluid properties and other parameters, such as the pressure, temperature, density, viscosity, fluid composition and contamination can be used to monitor the fluid flow while the formation fluid is being pumped for sample collection. When it is determined that the formation fluid flowing through the flow lines is representative of the in situ conditions, the fluid is then collected in fluid chambers 24.

When tool 10 is conveyed into the borehole, the borehole fluid may be allowed to enter the lower sections of fluid chambers 24 via port 36. This causes internal pistons to move as borehole fluid fills the lower sections of fluid chambers 24.

This is because the hydrostatic pressure in the conduit connecting the lower sections of fluid chambers 24 and the borehole is greater than the pressure in the sample flow lines. Alternatively, the conduit can be closed by an electrically controlled valve and the lower sections of fluid chambers 24 can be filled with the borehole fluid after tool 10 has been positioned in the borehole. To collect the formation fluid in chambers 24, the piston pump in flow control module 20 is operated to selectively pump formation fluid into the sample flow lines through the various inlets 56 of probes 54. When the flow line pressure exceeds the hydrostatic pressure in the lower sections of fluid chambers 24, the formation fluid is routed to and starts to selectively fill the upper sections of fluid chambers 24. When the upper sections of fluid chambers 24 have been filled to a desired level, the valves connecting the chambers with the flow lines and the borehole are closed, which ensures that the pressure in chambers 24 remains at the pressure at which the fluid was collected therein. While one sampling procedure has been described, it should be recognize that other sampling procedures may be used depending upon the design of tool 10, the desired testing and sampling regime and other factors known to those skilled in the art.

The above-disclosed system for the estimation of relative permeability has significant advantages over known permeability estimation techniques. In particular, formation testing and sampling apparatus 10 combines both the pressure-testing capabilities of the known probe-type tool designs and large exposure volume of straddle packers. In addition, tool 10 is capable of testing, retrieving and sampling of large sections of a formation along the axis of the borehole, thereby improving, inter alia, permeability estimates in formations having heterogeneous matrices such as laminated, vugular and fractured reservoirs. Also, due to the tool's ability to test large sections of the formation at a time, the testing cycle time is much more efficient than the prior art tools. Further, the tool is capable of formation testing in any typical size borehole.

Even though FIG. 3 depicts a probe module having four probes that are circumferentially distributed uniformly about the expandable packer, it should be understood by those skilled in the art that other probe modules having other numbers of probes and/or having probes in other orientations are possible and are considered within the scope of the present disclosure. For example, referring to FIG. 4, therein is depicted an embodiment of a probe module that is generally designated 70. In the illustrated embodiment, probe module 70 includes an expandable packer 72 that may have an inner bladder, a mechanical layer disposed exteriorly of the inner bladder and one or more outer sealing layers, as described above. When fluid is pumped into the interior of the inner bladder, the inner sealing bladder expands radially causing radial expansion of the mechanical layer and radial expansion of the outer sealing layers. This radial expansion establishes a hydraulic connection between probes 74, 76 and the formation. In addition, this radial expansion preferably creates a sealing engagement between the outer sealing layers of expandable packer 72 and the surface of the wellbore. Probe module 70 includes a plurality of probes 74, three of four being visible in FIG. 4, that are uniformly circumferentially distributed around expandable packer 72. Likewise, probe module 70 includes a plurality of probes 76, three of four being visible in FIG. 4, that are uniformly circumferentially distributed around expandable packer 72. In the illustrated embodiment, probes 74 and probes 76 form two longitudinally separated arrays of probes. Together, probes 74, 76 facilitate testing, sampling and retrieval of fluids from the formation. In addition, a tool 10 including probe module 70 is capable of efficiently testing, retrieving and sampling of large sections of a formation along the axis of the borehole, thereby improving, inter alia, permeability estimates in formations having heterogeneous matrices such as laminated, vugular and fractured reservoirs.

Figure 4:
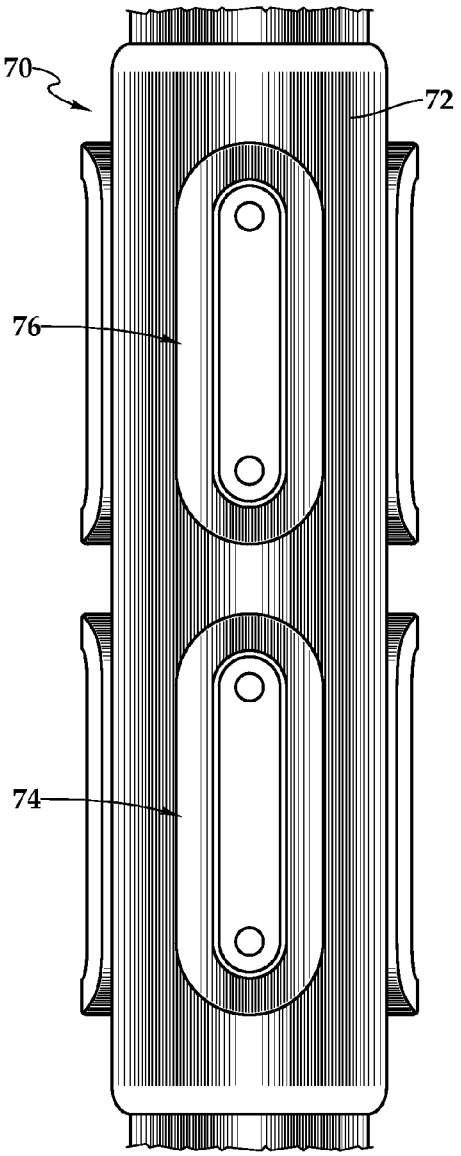
FIG. 4 is a schematic illustration of an embodiment of a probe module for use in a downhole formation testing and sampling apparatus.

Even though FIG. 4 depicts a probe module having two arrays of four probes that are circumferentially distributed uniformly about the expandable packer and longitudinally aligned with one another, it should be understood by those skilled in the art that other probe modules having other numbers of probes and/or having probes in other orientations are possible and are considered within the scope of the present disclosure. For example, referring to FIG. 5, therein is depicted an embodiment of a probe module that is generally designated 80. In the illustrated embodiment, probe module 80 includes an expandable packer 82 that may have an inner bladder, a mechanical layer disposed exteriorly of the inner bladder and one or more outer sealing layers, as described above. When fluid is pumped into the interior of the inner bladder, the inner sealing bladder expands radially causing radial expansion of the mechanical layer and radial expansion of the outer sealing layers. This radial expansion establishes a hydraulic connection between probes 84, 86 and the formation. In addition, this radial expansion preferably creates a sealing engagement between the outer sealing layers of expandable packer 82 and the surface of the wellbore. Probe module 80 includes a plurality of probes 84, three of four being visible in FIG. 5, that are uniformly circumferentially distributed around expandable packer 82. Likewise, probe module 80 includes a plurality of probes 86, two of four being visible in FIG. 5, that are uniformly circumferentially distributed around expandable packer 82. In the illustrated embodiment, probes 84 and probes 86 form two longitudinally separated arrays of probes that are phased at 45 degrees from one another. Together, probes 84, 86 facilitate testing, sampling and retrieval of fluids from the formation. In addition, a tool 10 including probe module 80 is capable of efficiently testing, retrieving and sampling of large sections of a formation along the axis of the borehole, thereby improving, inter alia, permeability estimates in formations having heterogeneous matrices such as laminated, vugular and fractured reservoirs.

Figure 5:
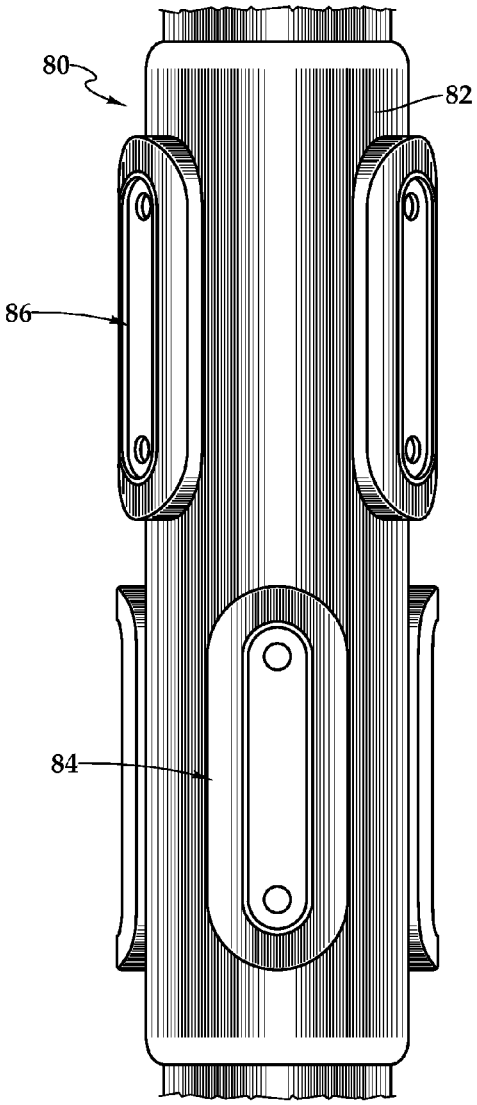
FIG. 5 is a schematic illustration of an embodiment of a probe module for use in a downhole formation testing and sampling apparatus.
Figure 6:
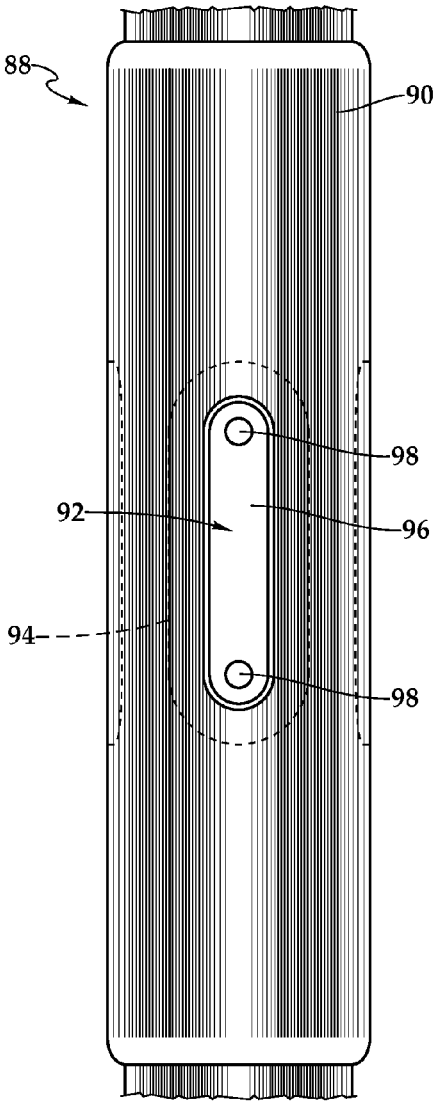
FIG. 6 is a schematic illustration of an embodiment of a probe module for use in a downhole formation testing and sampling apparatus.

Even though FIGS. 3-5 depict probe modules having probes that radially extend outwardly from the outer surface of the expandable packer, it should be understood by those skilled in the art that other probe modules having other probe designs are possible and are considered within the scope of the present disclosure. For example, referring to FIG. 6, therein is depicted an embodiment of a probe module that is generally designated 88. In the illustrated embodiment, probe module 88 includes an expandable packer 90 that may have an inner bladder, a mechanical layer disposed exteriorly of the inner bladder and one or more outer sealing layers, as described above. When fluid is pumped into the interior of the inner bladder, the inner sealing bladder expands radially causing radial expansion of the mechanical layer and radial expansion of the outer sealing layers. This radial expansion establishes a hydraulic connection between probes 92 and the formation. In this embodiment, portions of expandable packer 90, for example, those portions delineated by dashed lines 94, serve as the sealing pads of probes 92. Positioned in a slot or recess within each of the sealing pads is a steel aperture 96 that includes two inlets 98 for independently obtaining fluid samples. As illustrated, probe module 88 includes a plurality of probes 92, three of four being visible in FIG. 6, that are uniformly circumferentially distributed around expandable packer 90. A tool 10 including probe module 88 is capable of efficiently testing, retrieving and sampling of large sections of a formation along the axis of the borehole, thereby improving, inter alia, permeability estimates in formations having heterogeneous matrices such as laminated, vugular and fractured reservoirs.

Use of probe modules 50, 70, 80, 90 enable the performance of a variety of test regimes by enabling isolation of specific probes and/or specific inlets of the various probes to obtain information relative to the various sealed regions of the wellbore. For example, pressure gradient tests may be performed in which formation fluid is drawn into one or more probes and changes in pressure are detected at other probes that are isolated from the probes drawing fluid. As described above, fluid isolation between the probes or between inlets of the probes may be accomplished by the control unit. Additionally, formation anisotropy can be determined by observing pressure changes between probes during flowing periods or during pressure buildup periods. In addition, by having multiple probes it is possible to determine the direction or tensor of the anisotropy.

Figure 7A:
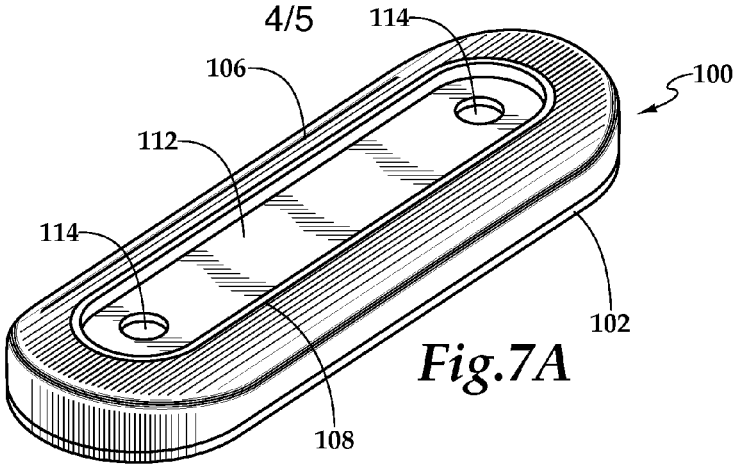
FIGS. 7A-7F are various views of an embodiment of a probe for use in a downhole formation testing and sampling apparatus.
Figure 7B:
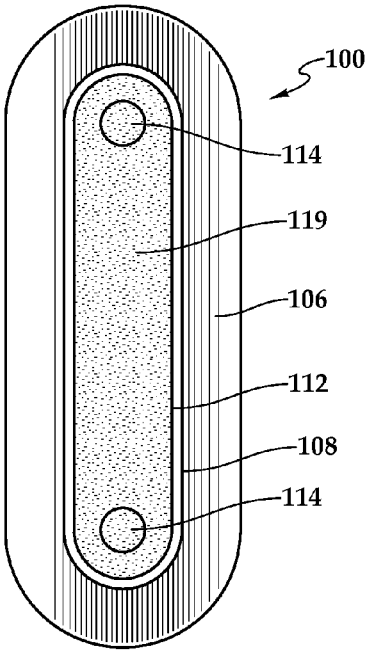
Figure 7C:
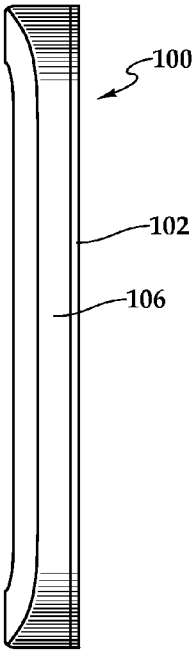
Figure 7E:
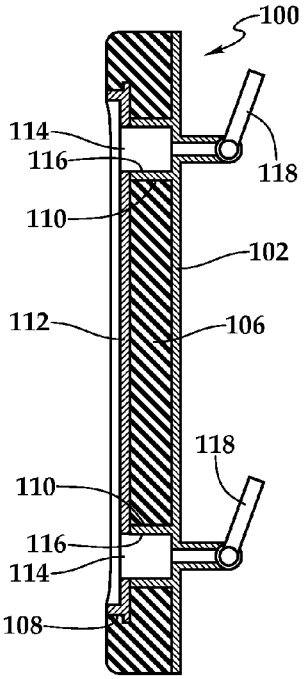
Figure 7D:
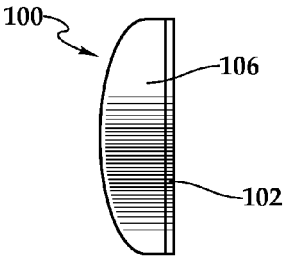
Figure 7F:
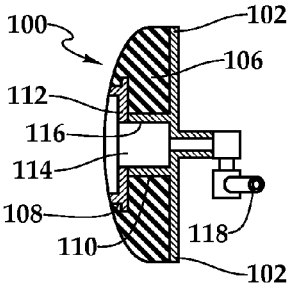

Referring next to FIGS. 7A-7F, therein are depicted various views of an embodiment of a probe that is generally designated 100. In the illustrated embodiment, probe 100 has a rigid base 102 that may be used to secure probe 100 to an expandable packer. Probe 100 has an elastomeric sealing pad 106 that is securably attached to rigid base 102. As described above, sealing pad 106 has an elongated structure with a recess 108. In addition, sealing pad 106 has a pair of openings 110, as best seen in FIGS. 7E and 7F. Sealing pad 106 has a radius of curvature designed to generally match that of the borehole into which sealing pad 106 is deployed, as best seen in FIGS. 7C, 7D and 7F. In the illustrated embodiment, recess 108 has a steel aperture 112 that is securably disposed therein and attached to sealing pad 106, as best seen in FIGS. 7E and 7F. Steel aperture 112 has a pair of inlets 114 that align with fluid passageways 116, as best seen in FIGS. 7E and 7F. Fluid passageways 116 are fluidically coupled to flow lines 118 of tool 10 enabling formation fluids entering inlets 114 to be routed within and tested by tool 10. As illustrated, flow lines 118 have a rotating connection with fluid passageways 116 and may be disposed between the inner bladder and the outer sealing layers of the expandable packer or to the interior of the inner bladder. In alternate embodiments, flow lines 118 may have an articulating connection, a telescopic connection or the like that enables the deployment of probe 100 in the manner described above while maintaining the fluid connection between flow lines 118 and fluid passageways 116. Alternatively or additionally, flow lines 118 may be flexible. Steel aperture 112 may have an optional screen element 119 positioned therein, such as a gravel pack, a sand pack or other filter medium that is operable to filter migrating solid particles such as sand and drilling debris from entering tool 10, only depicted in FIG. 7B. In operation, when fluid is pumped into the interior of the expandable packer causing radial expansion thereof, the elastomeric material of sealing pad 106 is compressed against the surface of the wellbore. The radial expansion of the expandable packer continues to apply force to probe 100, causing contact between steel aperture 112 and the surface of the wellbore. It will be appreciated that steel aperture 112 is pressed against the borehole wall with greater force than the elastomeric material of sealing pad 106. This system of deployment insures that steel aperture 112 keeps the rubber from extruding and creates a more effective seal.

Figure 8A:
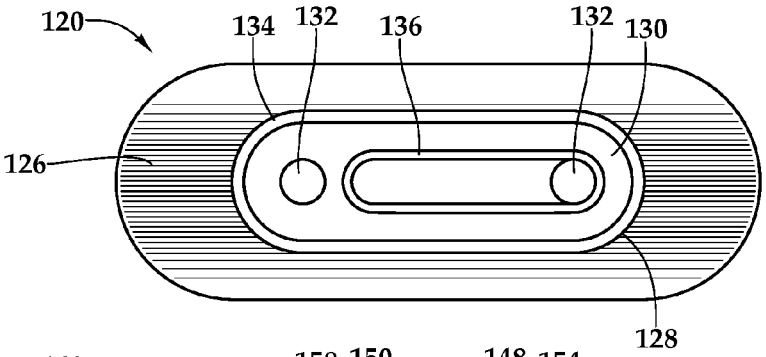
FIGS. 8A-8E are schematic illustrations of various embodiments of a probe for use in a downhole formation testing and sampling apparatus.

Referring next to FIGS. 8A-8E, therein are depicted various embodiments of probes that are operable for use with the above described probe modules 16, 50, 70, 80, 88 and the downhole formation testing and sampling apparatus 10. As best seen in FIG. 8A, probe 120 has an elastomeric sealing pad 126 that may be securably attached to a rigid base or may be molded to or integral with an expandable packer. Sealing pad 126 has an elongated structure with a recess 128. Recess 128 has a steel aperture 130 that is securably disposed therein and attached to sealing pad 126. Steel aperture 130 has a pair of inlets 132. In addition, steel aperture 130 has a pair of raised lips, an outer lip 134 and an inner lip 136. In this embodiment, when probe 120 is in hydraulic connection with the formation, outer lip 134 forms a first sealed region and first fluid communication channel with the formation and inner lip 136 forms a second sealed region and second fluid communication channel with the formation allowing for independent fluid flow into each of the inlets 132. For example, the outer sealed region may be flowed at one drawdown pressure while the inner sealed region may be flowed at a different drawdown pressure. In certain embodiments, outer lip 134, inner lip 136 or both may include an elastomeric element to improve sealing.

Figure 8B:
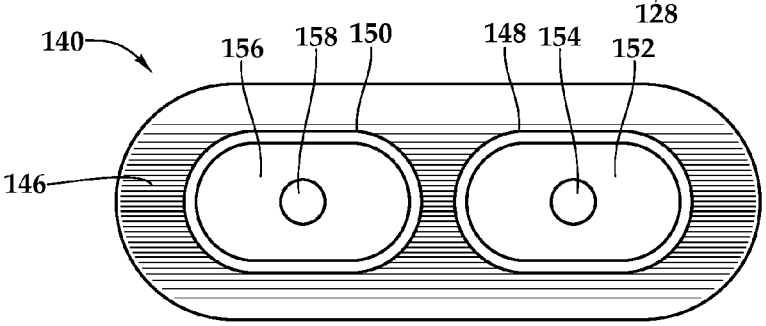

As best seen in FIG. 8B, probe 140 has an elastomeric sealing pad 146 that may be securably attached to a rigid base or may be molded to or integral with an expandable packer. Sealing pad 146 has an elongated structure with a pair of recesses 148, 150. Recess 148 has a steel aperture 152 that is securably disposed therein and attached to sealing pad 146. Steel aperture 152 has a single inlet 154. Likewise, recess 150 has a steel aperture 156 that is securably disposed therein and attached to sealing pad 146. Steel aperture 156 has a single inlet 158. In this embodiment, when probe 140 is in hydraulic connection with the formation, steel aperture 152 forms a first sealed region and first fluid communication channel with the formation and steel aperture 156 forms a second sealed region and second fluid communication channel with the formation allowing for independent fluid flow into each of the inlets 154, 158.

Figure 8C:
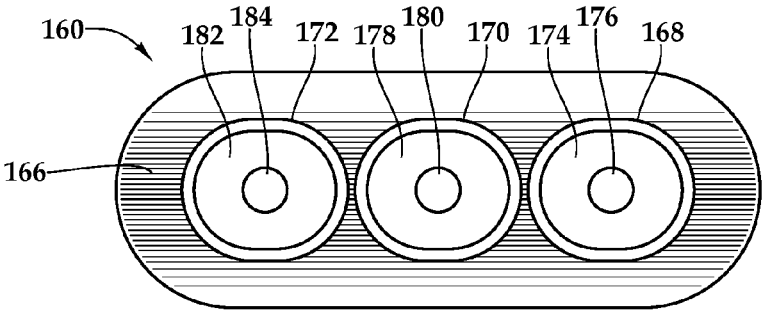

As best seen in FIG. 8C, probe 160 has an elastomeric sealing pad 166 that may be securably attached to a rigid base or may be molded to or integral with an expandable packer. Sealing pad 166 has an elongated structure with three recesses 168, 170, 172. Recess 168 has a steel aperture 174 that is securably disposed therein and attached to sealing pad 166. Steel aperture 174 has a single inlet 176. Likewise, recess 170 has a steel aperture 178 that is securably disposed therein and attached to sealing pad 166. Steel aperture 178 has a single inlet 180. Further, recess 172 has a steel aperture 182 that is securably disposed therein and attached to sealing pad 166. Steel aperture 182 has a single inlet 184. In this embodiment, when probe 160 is in hydraulic connection with the formation, steel aperture 174 forms a first sealed region and first fluid communication channel with the formation, steel aperture 178 forms a second sealed region and second fluid communication channel with the formation and steel aperture 182 forms a third sealed region and third fluid communication channel with the formation allowing for independent fluid flow into each of the inlets 176, 180, 184.

Figure 8D:
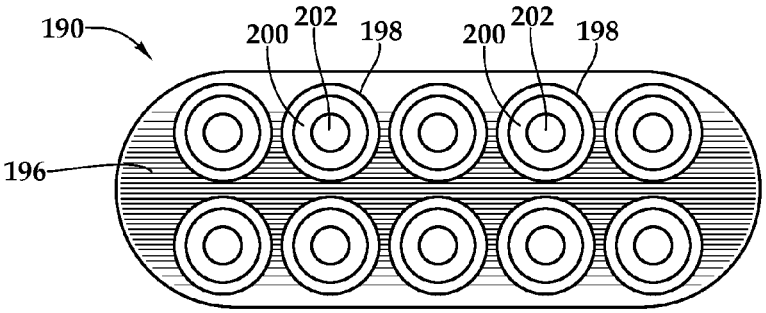

As best seen in FIG. 8D, probe 190 has an elastomeric sealing pad 196 that may be securably attached to a rigid base or may be molded to or integral with an expandable packer. Sealing pad 196 has an elongated structure with a 2×5 array of recesses 198. Each of the recesses 198 has a steel aperture 200 that is securably disposed therein and attached to sealing pad 196. Each steel aperture 200 has a single inlet 202. In this embodiment, when probe 190 is in hydraulic connection with the formation, each steel aperture 200 forms a sealed region and fluid communication channel with the formation allowing for independent fluid flow into each of the inlets 202.

Figure 8E:
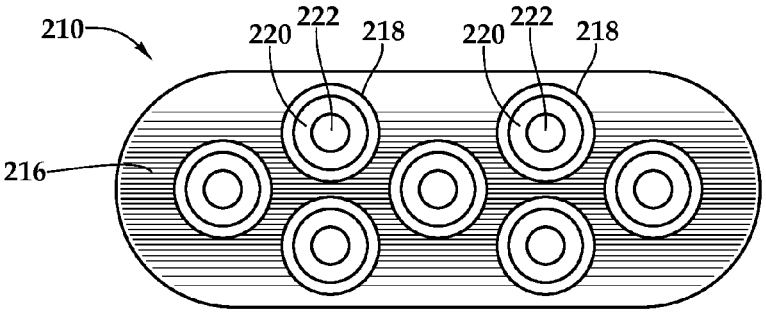

Even though FIG. 8D has depicted a probe having a particular number of recesses in a uniform array, those skilled in the art will understand that other probes could have other arrangements of other numbers of recesses. For example, as best seen in FIG. 8E, probe 210 has elastomeric sealing pad 216 that may be securably attached to a rigid base or may be molded to or integral with an expandable packer. Sealing pad 216 has an elongated structure with a non-uniform array of seven recesses 218. Each of the recesses 218 has a steel aperture 220 that is securably disposed therein and attached to sealing pad 216. Each steel aperture 220 has a single inlet 222. In this embodiment, when probe 210 is in hydraulic connection with the formation, each steel aperture 220 forms a sealed region and fluid communication channel with the formation allowing for independent fluid flow into each of the inlets 222.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. A downhole formation testing and sampling apparatus comprising:

an expandable packer having a radially contracted running configuration and a radially expanded deployed configuration; and a first longitudinally elongated sealing pad operably associated with the expandable packer, the first elongated sealing pad having an outer surface operable to seal a region along a surface of the formation to establish a hydraulic connection therewith when the expandable packer is operated from the running configuration to the deployed configuration, and first and second openings formed through said sealing pad for establishing fluid communication within said region between the formation and an interior of the apparatus, said first opening being longitudinally and circumferentially offset from said second opening;

wherein, the first opening is fluidly isolated from the second opening within said interior of the apparatus when said elongated sealing pad is in the deployed configuration.

2. The apparatus as recited in claim 1 further comprising a fluid collection chamber for storing samples of retrieved fluids.

3. The apparatus as recited in claim 1 wherein the first elongated sealing pad further comprises an elastomeric material.

4. The apparatus as recited in claim 3 wherein the elastomeric material of the first elongated sealing pad is reinforced with a steel aperture near the first opening.

5. The apparatus as recited in claim 1 further comprising a sensor for determining a property of the collected fluid.

6. The apparatus as recited in claim 1 wherein the first elongated sealing pad further comprises a filter medium.

7. The apparatus as recited in claim 1 further comprising a pumping system operably associated with the expandable packer and operable to selectively inflate the expandable packer.

8. A downhole formation testing and sampling apparatus comprising:

an expandable packer having a radially contracted running configuration and a radially expanded deployed configuration; and a plurality of longitudinally elongated sealing pads operably associated with the expandable packer, each elongated sealing pad having an outer surface operable to seal a region along a surface of the formation to establish a hydraulic connection therewith when the expandable packer is operated from the running configuration to the deployed configuration, wherein, each of the elongated sealing pads has first and second openings establishing independent isolated fluid communications between the formation and the interior of the apparatus, said first opening being longitudinally and circumferentially offset from said second opening; and wherein, each of the elongated sealing pads has at least one recess operable to establish fluid flow from the formation to the first opening.

9. The apparatus as recited in claim 8 wherein the elongated sealing pads are circumferentially distributed about the expandable packer.

10. The apparatus as recited in claim 8 wherein the elongated sealing pads are uniformly circumferentially distributed about the expandable packer.

11. The apparatus as recited in claim 8 wherein the elongated sealing pads are longitudinally distributed about the expandable packer.

12. The apparatus as recited in claim 8 wherein the elongated sealing pads are circumferentially and longitudinally distributed about the expandable packer.

13. The apparatus as recited in claim 8 further comprising a pumping system operably associated with the expandable packer and operable to selectively inflate the expandable packer.

14. A method of testing and sampling formation fluid comprising:

running a formation testing and sampling apparatus into a borehole, the apparatus having an expandable packer and at least one longitudinally elongated sealing pad operably associated with the expandable packer, the at least one elongated sealing pad having an outer surface operable to seal a region along a surface of the formation to establish a hydraulic connection therewith, the at least one elongated sealing pad having first and second openings each in independent isolated fluid communication with the interior of the apparatus and the at least one elongated sealing pad having at least one recess operable to establish fluid flow from the formation to the first opening, said first opening being longitudinally and circumferentially offset from said second opening;

pumping a fluid into the expandable packer to inflate the expandable packer from a radially contracted running configuration to a radially expanded deployed configuration;

establishing a first hydraulic connection between the first opening and the formation;

establishing a second hydraulic connection independent of the first hydraulic connection between the second opening and the formation; and drawing fluid from the region of the formation into the apparatus.

15. The method as recited in claim 14 further comprising collecting the fluid in a fluid collection chamber of the apparatus.

16. The method as recited in claim 14 further comprising sensing at least one characteristic of the fluid drawn into the apparatus.

17. The method as recited in claim 14 further comprises regulating a drawdown of fluids into the apparatus using a control device.

18. The method as recited in claim 14 further comprising establishing a plurality of independent isolated hydraulic connections between the plurality of elongated sealing pads and the formation.

* * * * *